United States Patent [19]

Hurvitz

[11] 4,211,102

[45] Jul. 8, 1980

[54] METHOD AND MEANS FOR PROCESSING METAL SHEETS

[76] Inventor: Arnold Hurvitz, 327 Rosemary La., Narberth, Pa. 19072

[21] Appl. No.: 957,656

[22] Filed: Nov. 3, 1978

[51] Int. Cl.[2] ..... B21D 22/00

[52] U.S. Cl. ..... 72/304; 72/312; 72/351; 72/378

[58] Field of Search ..... 72/296, 297, 304, 312, 72/351, 378, 379

[56] References Cited

U.S. PATENT DOCUMENTS

| | | | |
|---|---|---|---|
| 1,923,334 | 8/1933 | Spatta | 72/378 |
| 2,064,160 | 12/1936 | Hochreiter et al. | 72/312 |
| 2,350,884 | 6/1944 | Ernst | 72/312 |
| 2,485,354 | 10/1949 | Brennan | 72/304 |
| 3,990,288 | 7/1975 | Mackenzie | 72/304 |

*Primary Examiner*—Milton S. Mehr
*Attorney, Agent, or Firm*—Jacob Trachtman

[57] ABSTRACT

Method of processing metal sheets which includes the steps of applying tensile stress to an intermediate region of a sheet of metal by engaging the sheet on opposite sides of the region, deforming the intermediate region of the sheet and removing the tensile stress applied to the sheet. The intermediate region of the sheet may be deformed by embossing and the tensile stress can be applied to the intermediate region of the sheet by forming a bead on opposite sides of the region. The means for processing metal sheets comprises first means including die members for forming beads on opposite sides of a metal sheet, and second means for deforming the intermediate region of the sheet while the stress is applied thereto by the first means.

26 Claims, 9 Drawing Figures

Figures 4, 6, 7, 8:
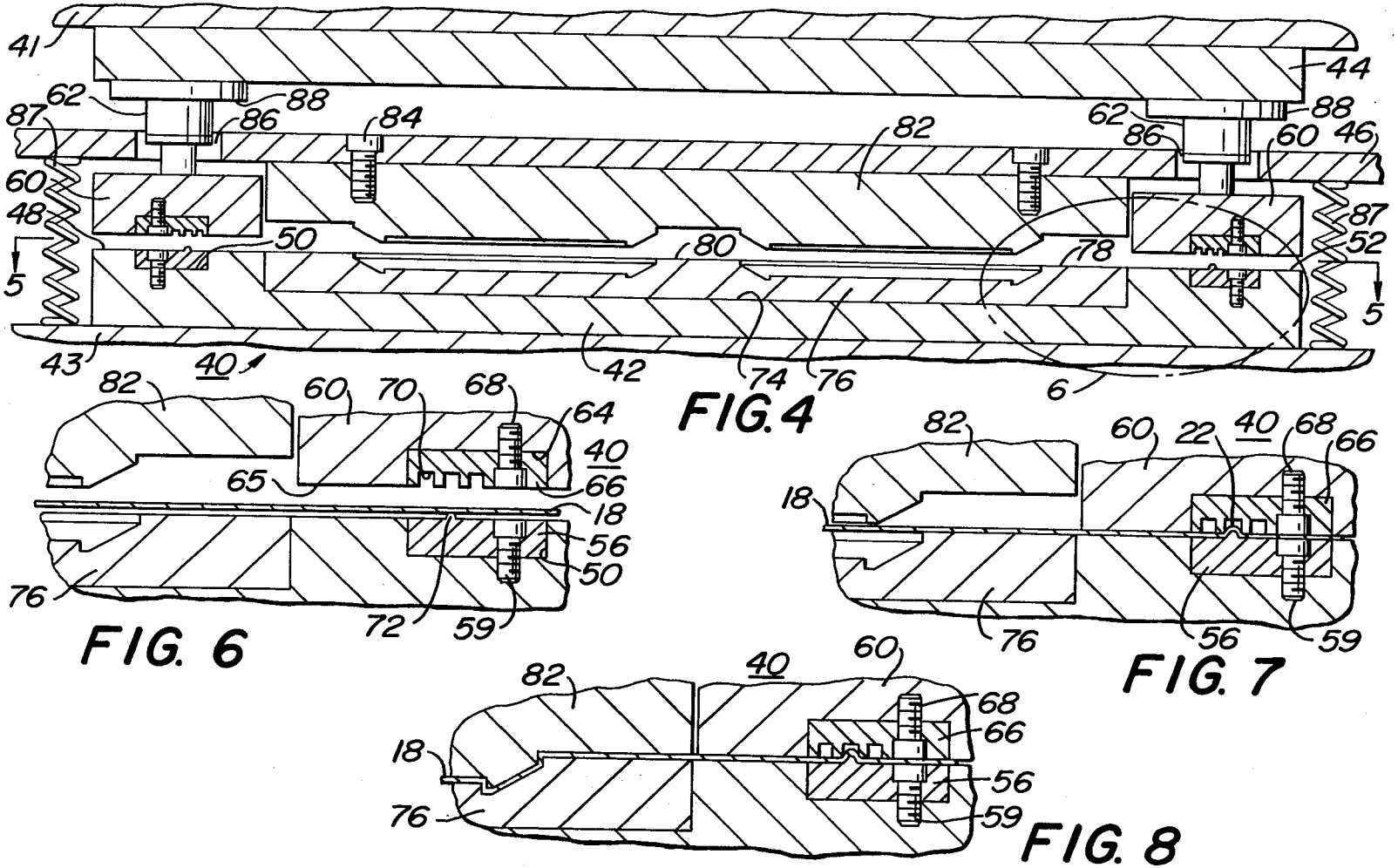

FIG. 1
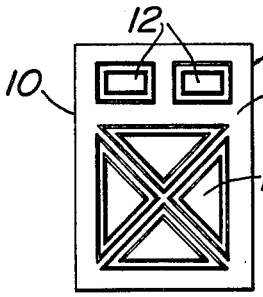
FIG. 2
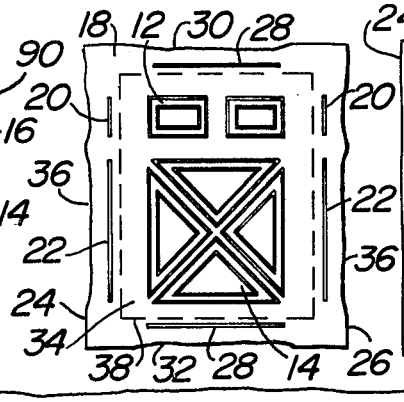
FIG. 3
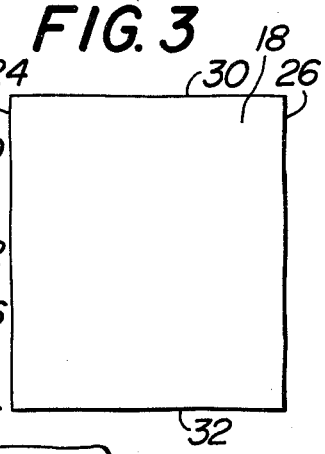
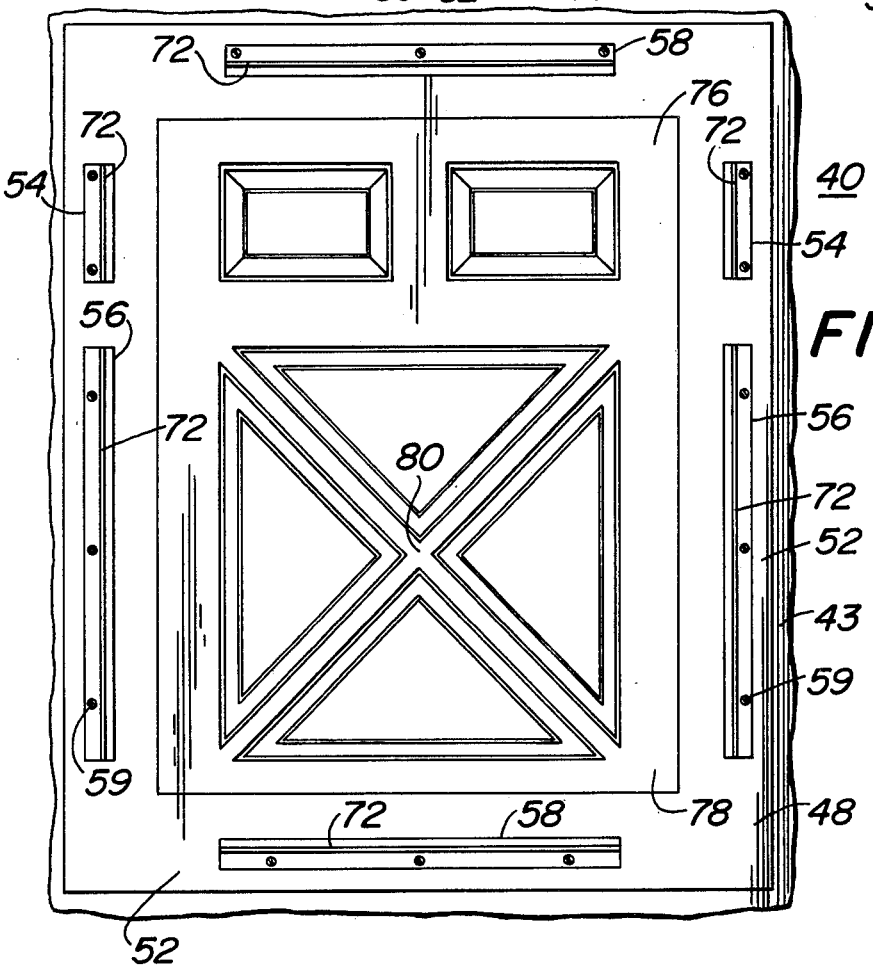
FIG. 5

METHOD AND MEANS FOR PROCESSING METAL SHEETS

The invention relates to a method and means for processing metal sheets and the product produced thereby, and more particularly a method and means for processing metal sheets which have defects or distortions which also may be latent, and the product produced thereby in which such defects and distortions are removed.

Heretofore, many metal products have been made from flexible sheets of steel, aluminium and other metals. Metal sheets and especially sheets made of steel, usually have various defects or distortions resulting from the manufacturing, handling and storing of the material, which distortions are commonly known in the trade as "oil can," "camber," "center buckle," and "edge wave." Such defects in the metal, in many cases become more evident when rolls of the sheet material or large sheets of metal are cut into smaller blanks for processing and/or after being made into the final product. Unless such deformities are removed before or during processing, the resulting product will have evident defects or undesirable deformities. Although sheet metal may be ordered to specification as prefectly flat, such metal material is much more costly and still may contain latent "shapes" which become evident only after the material is subjected to a forming process.

Therefore, a principal object of the invention is to provide a new and improved method and means for processing metal sheets which may utilize material blanks which are not perfectly flat for producing metal sheet products without defects or distortions.

Another object of the invention is to provide a new and improved method and means for producing metal products from sheet metal material which has been painted or otherwise coated prior to processing.

Another object of the invention is to provide a new and improved method and means for processing metal sheets which remove apparent and latent defects in sheet metal without adversely affecting the metal product as a result of the method and means utilized.

Another object of the invention is to provide a new and improved method and means for processing metal sheets for producing deeply embossed panels from which apparent, and latent defects have been removed.

Another object of the invention is to provide a new and improved method and means for processing metal sheets which allow the use of inexpensive sheet material for producing metal products of desired quality.

Another object of the invention is to provide a new and improved method and means for processing metal sheets which is efficient, inexpensive and highly productive.

The above objects as well as many objects of the invention are achieved by providing a method for processing metal sheets which includes the steps of applying tensile stress to an intermediate region of a sheet of metal by engaging the sheet on opposite sides of the region, deforming the intermediate region of the sheet, and removing the tensile stress applied to the sheet. The tensile stress is applied to the intermediate region of the sheet by forming at least one set of beads in the sheet on opposite sides of the region, and then embossing the intermediate region. After the intermediate region has been embossed and the tensile stress is removed from the sheet, the beads formed on opposite sides of the intermediate region of the sheet are removed by trimming. This leaves a sheet metal product having an em bossed region, and which product does not include the defects and imperfections which may have been present prior to the processing of the sheet of metal. This method is most effective especially in connection with steel which has a memory or "spring back" tending to maintain defects which are present in the material.

The means of the invention includes a first means for engaging a metal sheet on opposite sides and applying tensile stress to its intermediate region, second means for deforming the intermediate region of the sheet while the stress is applied by the first means, and third means for supporting the first and second means. The first and second means respectively include first and second sets of engageable and disengageable corresponding male and female die members, the first set of die members forming a bead in opposite sides of the metal sheet to apply tensile stress to the intermediate region of the sheet, and the second set of die members embossing the intermediate region of the sheet. The third means supports the first and second sets of die members for respective movement into engaged and disengaged positions, and includes fourth means activating the third means for moving the first set of die members into engagement while the second set of die members are disengaged, moving the second set of die members into engagement and disengagement while the first set of die members are engaged, and disengaging the first set of die members after the second set of die members are disengaged.

Figure 9:
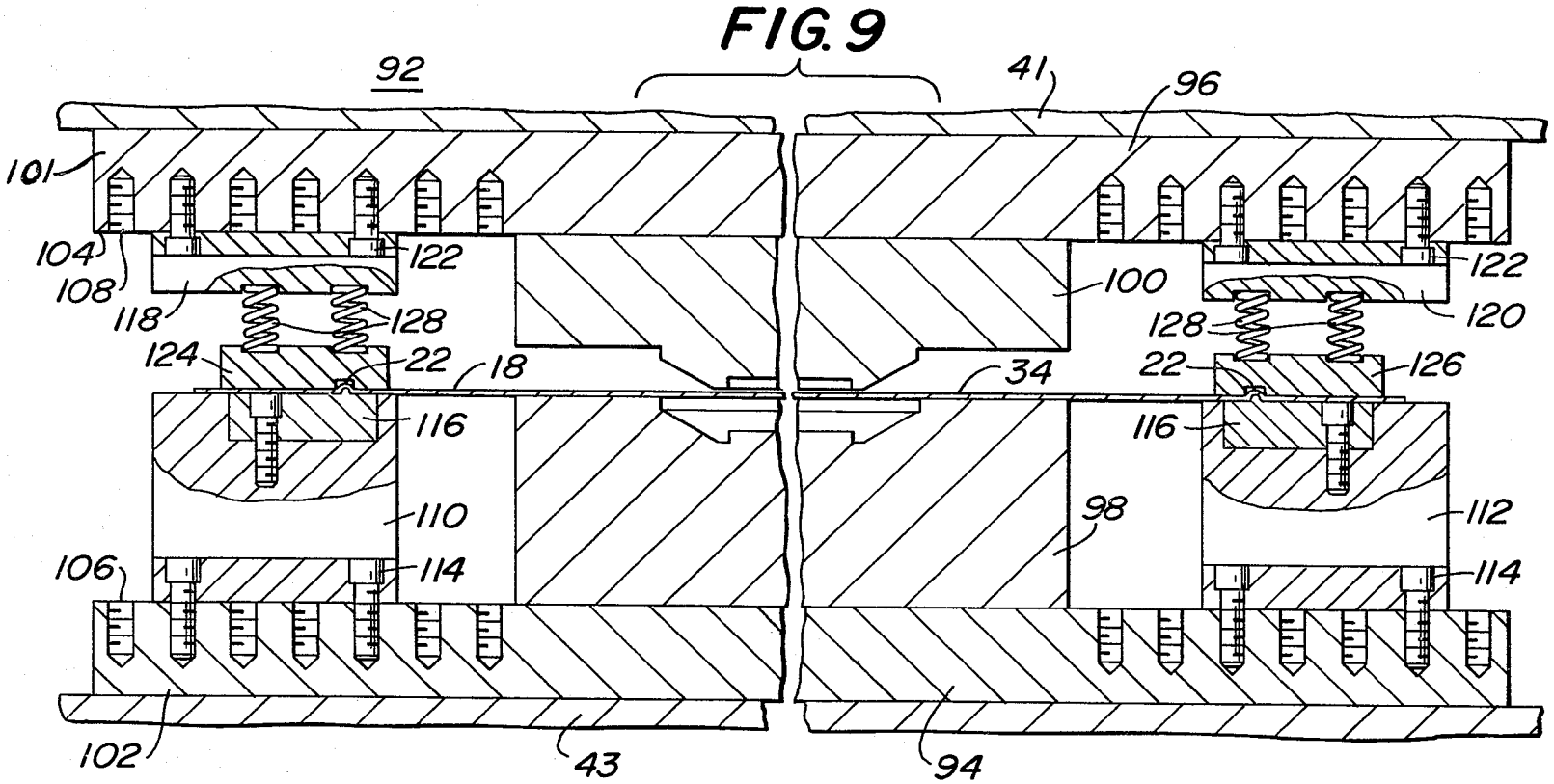

The foregoing and other objects of the invention will become more apparent when the following detailed description of the invention is read in conjunction with the drawing, in which:

FIG. 1 is a top plan view of a metal product of the invention,

FIG. 2 is a top plan view of the metal product of FIG. 1, prior to the trimming operation, FIG. 3 is a top plan view of a sheet metal blank used by the invention for producing the sheet metal product of FIG. 1, FIG. 4 is a sectional view of a portion of the means for carrying out the method and producing the metal product of the invention, FIG. 5 is a top plan view taken on the line 5—5 of FIG. 4, FIG. 6 is an enlarged fragmentary view of the means of FIG. 4 shown within the dashed lines 6, FIG. 7 is a view similar to FIG. 6 illustrating the formation of a bead in the sheet of metal, FIG. 8 is a view similar to FIG. 6 illustrating the embossing of the intermediate region of the sheet of metal, and FIG. 9 is a sectional view of another form of means for carrying out the method and producing the metal product of the invention.

Like numerals designate like parts throughout the several views.

In referring to the figures, FIG. 1 illustrates a sheet metal product produced by the invention in the form of a rectangular door panel. The door panel 10 is made of a sheet of malleable material, such as steel or aluminium, that has been deeply embossed to provide a design formed by the pair of the depressed rectangular region 12 at the top and the four triangular depressed regions 14 providing a substantially square outer rectangular configuration extending from the intermediate portion to the bottom of the panel 10. The regions 16 bordering the embossed designs 12 and 14 and extending between them are flat and do not have defects or distortions which may have been present in the original rectangular blank sheet 18 of metal shown in FIG. 3.

In the process of making the panel 10, the blank sheet 18 is subjected to means which form pairs of beads 20 and 22 in the sheet 18 extending along the longitudinal edges 24 and 26 of the blank sheet 18. A pair of transverse beads 28 are also formed at the top and bottom of the blank sheet 18 proximate to its edges 30 and 32. The forming of the beads 20, 22 and 28 about the intermediate region 34 of the sheet 18, takes up material and results in the application of tensile stress to the intermediate region 34. After forming the beads 20, 22 and 28, the beads are maintained in their fixed position, so that the tensile stress produced in the intermediate region is not relieved until the completion of the sheet fabricating operation. The take-up of material by the forming of the beads 20, 22 and 28 is evident along the outer edges 24, 26, 30 and 32 by the concave edge regions 36 produced opposite to the beads 20, 22 and 28.

With the beads formed and maintained in spaced position on opposite sides of the intermediate region 34, the designs provided by the embossed regions 12 and 14 are formed. This may be done by the use of male and female die members, as well known in the art. The beads, 20 22, 28 may also have been formed by die members which are maintained in position and engagement with the blank 18 during the deformation of the intermediate region 34 during the embossing operation. With the completion of the embossing operation, in the intermediate region 34, the tension applied to the blank 18 is removed from the intermediate region 34 and the blank 18 is released.

At this time, the blank 18 appears as shown in FIG. 2. The intermediate region 34 and the beads 20, 22 and 28 retain their configuration and integrity and the portion 16 of the intermediate region 34 which has not been embossed remains flat and void of defects which may have originally been present in the blank 18.

In order to provide the final product 10, the blank 18 is trimmed along the dashed line 38 to remove the beads 20, 22 and 28 and provide the rectangular outer edges 90 of the door panel 10 shown in FIG. 1. With the trimming of the beads 20, 22 and 28, the door panel 10 does not suffer deformation or evidence defects which may have been present or latent in the original sheet 18 shown in FIG. 3.

Although FIGS. 1 and 2 illustrate a particular design, the invention may be applied to produce various designs and configurations while allowing the use of stock material which contain apparent and latent defects to provide high quality products from which such defects are absent. Although the illustrated sets of beads 20, 22 and 28 are disconnected and positioned directly opposite to the embossed regions 12 and 14 of the sheet 18, the beads may be continuous and without interruption, or may otherwise be arranged to provide the advantages of the invention.

It is also noted that in addition to not requiring special flat metal stock, the blank sheet 18 utilized may also be prepainted. This allows the production of the final metal product without requiring an additional painting or finishing step. This results in cost saving, since the original sheet metal may be processed in large sheets or strips suitable for mass production techniques.

Refer to FIGS. 4 to 8 for description of the means or apparatus 40 for processing metal sheets in accordance with the invention. The apparatus 40 comprises a base plate 42 and top plates 44 and 46 which are moveable with respect to the base plate 42. The base plate 42 provides a top surface 48 having elongated slots 50 (FIG. 4) along its edges 52. The slots 50 receive elongated inserts 54, 56 and 58 arranged in opposite pairs. The inserts 54, 56 and 58, are each secured within their respective slots 50 by bolt means 59 (FIG. 6). The inserts 54, 56, and 58 each provide a male die member for forming a bead in blank sheet 18, which is to be processed by the apparatus 40. A plurality of bodies 60 depend from the top plate 44 each supported by a normally extended retractable unit 62. The bodies 60 are normally positioned over the edge portions 52 of the base plate 42 and in spaced relationship therefrom as shown in FIGS. 4 and 6. Each of the bodies 60 are also provided with an elongated slot 64 in its bottom surface 65 (FIG. 6) for receiving inserts 66. Each insert 66 provides a female die member which is removeable secured in its slot 64 by bolt means 68. The male and female die members of the inserts 56 and 66 are arranged so that the protrusion 72 of each insert 56 enters a select one of the grooves 70 of the proximately positioned insert 66 for forming a bead such as the bead 22 in the blank sheet 18 as illustrated in FIG. 7.

In order to adjust the location of and distance of the beads of each pair of beads with respect to each other and the edges of the sheet 18, the male inserts 56 may be removed and replaced by inserts providing a protrusion 72 at a location corresponding to another groove 70 of the female die members 66. The ability to change the distance between pairs of beads formed in the sheet material 18 is of importance, since if a smaller metal product is to be produced, spacing the pairs of beads more closely together, allows the use of a smaller blank sheet of material. This reduces the amount of metal used and the cost of the final product.

The central region 74 of the base plate 42 is cut out to receive a rectangular female die member 76 intermediate to the die members 56 which are positioned about its edges 52. The marginal regions 78 of the die members 76, as well as other regions 80, are flat and level with the top surfaces 48 of the edges 52 of the base plate 42. A complementary male die member 82 is secured by bolt means 84, to the bottom surface of the top plate 46 and normally spaced above the die member 76 as illustrated in FIG. 4. The top plate 46 and die member 82 are supported by spring means 87 in their normal positions shown in FIG. 4, and are moveable in a downward direction when activated, so that the die members 76 and 82 deform the intermediate region of the sheet 18 by deep embossing as shown in FIG. 8. The top plate 46 is also provided with openings 86 through which the retractable units 62 extend for supporting the bodies 60. The top means 44 and 46 are maintained in their normal position by means shown in FIG. 4 and by means which will be explained more fully in connection with the operation of the apparatus 40.

In the operation of the apparatus 40, a blank sheet of metal 18 is positioned as shown in FIG. 6 over the base member 42 between the sets of die members. The apparatus 40 may be activated by the application of compressive force by members 41 and 43 of a conventional means such as a hydraulic press to the top and bottom plates 44 and 42. This results in the downward movement of the top plate 44 and of the bodies 60 supported thereby. The continued downward movement of the bodies 60 results in the engagement and application of force to the end portions of the blank sheet 18 by the inserts 56 and 66 as shown in FIG. 7, and the gripping and the forming of beads such as the beads 20, 22 and 28 in the blank 18 of FIG. 2. The forming of the beads takes up material from the intermediate region 34 of the blank 18 applying a tensile stress thereto. The formation of the beads also results in depletion of material from along the edges of regions 36 of sheet 18 proximate to the beads as also shown in FIG. 2.

With the die members of inserts 56 and 66 in engagement with the sheet 18 and still applying tensile stress to its intermediate region, the continued downward motion of the top plate 44 results in the retraction of the units 62 and the engagement of the step 88 of plate 44 with the top surface of the top plate 46 in the region of its opening 86. The continued downward motion of the top plate 44 results in the downward movement of the plate 46, the compression of coil springs 87 positioned between it and the member 43, and its engagement with the intermediate region 34 of the blank sheet 18 as shown in FIG. 8. The full movement of the top plate 44 to its bottom position results in the application of high force by the complementary die members 76 and 82 to the sheet 18 providing the deeply embossed designs shown in FIGS. 1 and 2 in the regions 12 and 14.

At this time, the applied force is removed with the upward movement of the top plate 44 towards its normal position, allowing the plate 46 to move in turn upwardly into its normal position out of engagement with the intermediate region 34 of the blank sheet 18. The continued upward movement of the top plate 44 allows complete extension of the retractable unit 62 and then, the release of the edge portions of the blank 18 by the bead forming die members. The blank sheet 18 which has now been processed to the form shown in FIG. 2 is stripped and removed from the apparatus 40. The formed blank 18 is finished upon the removing of the edge portions including the beads 20, 22 and 28. This is done by trimming along the dashed line 38 in FIG. 2 to produce the door panel 10 with edge 90 of FIG. 1.

FIG. 9 is a sectional view of another apparatus 92 for carrying out the method of the invention, which is a modified form of the apparatus 40. The apparatus 92 has a base plate 94, and a top plate 96 which is movable in the upward and downward directions with respect thereto. An embossing female die member 98 is centrally secured on the top surface of the base plate 94, while the male embossing die member 100 is centrally secure to the bottom surface of the top plate 96 in spaced relationship above the bottom die member 98. The base and top plates 94 and 96 are provided with a plurality of spaced threaded openings 106, 108 through their top and bottom surfaces along their edge portions 100, 102. A pair of bodies are detachably secured to the base plate 94 by bolt means 114, allowing the bodies 110, 112 to be positioned at various locations with respect to each other and their intermediate die member 98. Each of the bodies 110, 112 has an insert 116 providing a male die member for forming a bead 22 along an edge portion of the blank sheet 18 as illustrated in FIG. 9. A pair of bodies 118, 120 are similarly secured by bolt means 122 to depend from the bottom surface of the top plate 96. A pair of die members 124, 126 are respectively secured in depending relationship with the bodies 118, 120 by a plurality of spring elements 128. The die members 124, 126 are normally positioned above and in spaced relationship to the male die members provided by the inserts 116 of the bodies 110, 112.

In operation, the top plate 96 is normally in a position raised with respect to that shown in FIG. 9, and a space is provided between the die members allowing the positioning of a blank sheet 18 over the surfaces of the bodies 110 and 112, the inserts 116, and of the embossing die member 98. With the activation of the apparatus 92, a compressive force is applied by the members 41 and 43 to the top and bottom plates 96, 94 resulting in the downward movement of the top plate 96 and in the engagement of the die members 124 and 126 with the marginal regions of the blank sheet 18. With the continued downward movement of the top plate 96, increasing force is exerted on the sheet 18 through the spring elements 128. This results in securely clamping and positioning the edge portions of the blank sheet 18 between the die members 124, 126 and the corresponding male insert members 116 of the bodies 110 and 112. This action forms the beads 22 and applies a tensile stress to the intermediate region 34 of the sheet 18. FIG. 9 shows the stage where the beads 22 have just been formed and tensile stress is exerted on the intermediate region 34 of the sheet 18. Continued downward movement of the top plate 96 increases the clamping action with which the edges are secured between the inserts 116 and their corresponding die members 124, 126 and causes the top central die member 100 to deform the intermediate region 34 of the sheet 18. The intermediate region of sheet 18, is thus, deformed for example to provide the deep embossed designs as illustrated in FIG. 2. With the completion of the embossing operation, the force exerted on the top member 96 is reduced and the top plate is moved in the upward direction disengaging the die member 100 from the intermediate region 34 of the sheet 18. The further upward movement of the top plate 96 allows the spring elements 124 to extend to their normal condition followed by the upward movement of the die members 124, 126. This results in disengagement of the die members 124, 126 from the top surface and the beads 22 formed in the sheet 18. In its normal deactivated condition, the apparatus 92 provides a space between its die members allowing the stripping and removal of the formed sheet 18. As explained previously in connection with the apparatus 40, the formed sheet 18 has an appearance such as shown in FIG. 2, and is finished by trimming along the line 38 to produce the finished sheet metal product.

Although, for purposes of illustration, the invention was described in connection with the production of a door panel, it is understood that many other articles and designs may be manufactured by the method and means of the invention with appropriate modification but without departing from the spirit of the invention.

What is claimed is:

1. A method of processing flat metal sheets which may have apparent or latent defects for providing embossed sheets with flat regions which includes the steps of applying tensile stress to an intermediate region of a substantially flat sheet of metal by engaging the sheet on opposite sides of said region while maintaining the sheet flat and its ends fixed with respect to each other, deforming a portion of the intermediate region of said sheet while the remaining undeformed portion of the sheet is maintained flat and the tensile stress is applied, and removing the tensile stress applied to said sheet to provide a metal sheet with intermediate deformed and undeformed flat portions with the undeformed portion being substantially in the same plane.

2. The method in accordance with claim 1 in which the intermediate region of said sheet is deformed by embossing.

3. The method in accordance with claim 1 in which tensile stress is applied to the intermediate region of said sheet by forming a bead at a fixed location on opposite sides of said region.

4. The method in accordance with claim 3 in which the beads are formed in said sheet by male and female die members which engage the sheet at the opposite sides of said region and deform the sheet at said regions for applying tensile stress therebetween to the intermediate region.

5. The method in accordance with claim 4 in which the intermediate region of the sheet is deformed by embossing.

6. The method in accordance with claim 5 in which the intermediate region of said sheet is embossed by male and female die members which engage and disengage the intermediate region of the sheet while the bead forming die members are in engagement at the opposite sides of the intermediate region of the sheet.

7. The method in accordance with claims 3, 4, 5, or 6 in which the sheet is trimmed to remove the beads formed on opposite sides of said region.

8. A sheet metal product made by the steps of applying tensile stress to an intermediate region of a substantially flat sheet of metal by engaging the sheet on opposite sides of said region while maintaining the sheet flat and its ends fixed with respect to each other, deforming a portion of the intermediate region of said sheet while the remaining undeformed portion of the sheet is maintained flat and the tensile stress is applied, and removing the tensile stress applied to said sheet to provide a metal sheet with intermediate deformed and undeformed flat protions with the undeformed portion being substantially in the same plane.

9. A sheet metal product made in accordance with claim 8 in which the intermediate region of said sheet is deformed by embossing.

10. A sheet metal product made in accordance with claim 8 in which tensile stress is applied to the intermediate region of said sheet by forming a bead at a fixed location on opposite sides of said region.

11. A sheet metal product made in accordance with claim 10 in which the beads are formed in said sheet by male and female die members which engage the sheet at the opposite sides of said region and deform the sheet at said regions for applying tensile stress therebetween to the intermediate region.

12. A sheet metal product made in accordance with claim 11 in which the intermediate region of the sheet is deformed by embossing.

13. A sheet metal product made in accordance with claim 12 in which the intermediate region of said sheet is embossed by male and female die members which engage and disengage the intermediate region of the sheet while the bead forming die members are in engagement at the opposite sides of the intermediate region of the sheet.

14. A sheet metal product made in accordance with claims 10, 11, 12, or 13 in which the sheet is trimmed to remove the beads formed on opposite sides of said region.

15. A means for processing substantially flat metal sheets which may have apparent or latent defects comprising first means for engaging a substantially flat metal sheet on opposite sides and applying tensile stress to its intermediate region while maintaining the sheet flat and its ends fixed with respect to each other, second means for deforming a portion of the intermediate region of said sheet while the remaining undeformed portion of the sheet is maintained flat and said stress is applied thereto by said first means, and third means for supporting said first and second means.

16. The means in accordance with claim 15 in which the first and second means respectively include first and second sets of engagable and disengagable corresponding male and female die members, the first set of die members forming and maintaining a bead at a fixed location in opposite sides of the metal sheet to apply tensile stress to the intermediate region of the sheet, and the second set of dies embossing the deformed portion of the intermediate region of the sheet.

17. The means in accordance with claim 16 in which said first set of die members have alterable portions for changing the locations of the beads formed in said sheet.

18. The means in accordance with claim 17 in which the alterable portions of said die members are removable inserts.

19. The means in accordance with claim 16 in which said first set of die members are adjustably secured at selected locations with said third means for changing the positions of the beads formed in said sheet.

20. The means in accordance with claim 19 in which said third means is provided with a plurality of spaced threaded openings and said die members are secured in selected locations by bolt means engaging openings of said third means.

21. The means in accordance with claim 16 in which said third means supports said first and second sets of die members for respective movement into engaged and disengaged positions, and includes fourth means activating said third means for moving said first set of die members into engagement only while said second set of die members are disengaged, moving said second set of die members into engagement and disengagement only while the first set of die members are engaged, and disengaging said first set of die members only after the second set of die members are disengaged.

22. The means in accordance with claim 21 in which said third means includes a bottom plate and a top plate for supporting said first and second sets of die members, said plates being opposite and movable with respect to each other for engaging and disengaging said die members.

23. The means in accordance with claim 22 in which said male and female die members of said second set are respectively secured oppose to each other with said bottom and top plates, and said male and female die members of said first set are respectively secured opposite each other with said bottom and top plates and about and on opposite sides of said second set of die members.

24. The means in accordance with claim 23 in which the top plate is provided with first and second sections movable with respect to each other with die members of said first set being supported by said first section and one of the die members of said second set being supported by said second section of said top plate, whereby said die members of said first set of members engage and form beads in the metal sheet prior to the engagement of said sheet by said second set of die members.

25. The means in accordance with claim 23 in which the top plate yieldingly supports die members of said first set in extended positions, whereby said die members of said first set of members engage and form beads in the metal sheet prior to the engagement of said sheet by said second set of die members.

26. A means for processing metal sheets comprising first means for engaging a metal sheet on opposite sides and applying tensile stress to its intermediate region, second means for deforming the intermediate region of said sheet while said stress is applied thereto by said first means, and third means for supporting said first and second means, the first and second means respectively including first and second sets of engagable and disengagable corresponding male and female die members, the first set of die members forming a bead in opposite sides of the metal sheet to apply tensile stress to the intermediate region of the sheet, and the second set of dies embossing the intermediate region of the sheet, the first set of die members having removable inserts for changing the locations of the beads formed in said sheet, the inserts of the female die members having a plurality of parallel grooves, and the inserts of the male die members being replaceable by selected inserts each providing an elongated protuberance for being received in a selected one of the grooves of its corresponding female die member.

* * * * *